US008448392B2

(12) United States Patent
Kuo

(10) Patent No.: US 8,448,392 B2
(45) Date of Patent: May 28, 2013

(54) MODULAR FLOOR TILE

(76) Inventor: Jen-Tsu Kuo, Changhua (TW)

( * ) Notice: Subject to any disclaimer, the term of this patent is extended or adjusted under 35 U.S.C. 154(b) by 168 days.

(21) Appl. No.: 13/090,259

(22) Filed: Apr. 20, 2011

(65) Prior Publication Data

US 2012/0266557 A1 Oct. 25, 2012

(51) Int. Cl.
*E04F 11/16* (2006.01)
*E04F 15/00* (2006.01)

(52) U.S. Cl.
USPC ..... 52/180; 52/591.1; 428/61; 428/82

(58) Field of Classification Search
USPC ..... 52/177, 578, 591.1, 591.5, 592, 592.1, 52/519, 384, 390, 392, 574, 591.4, 591.2, 52/403.1, 180, 589.1, 586.1, 582.2; 428/60, 428/61, 81, 88, 192; 446/85, 108, 110, 116
See application file for complete search history.

(56) References Cited

U.S. PATENT DOCUMENTS

| | | | | |
|---|---|---|---|---|
| 5,212,842 | A * | 5/1993 | Glydon | 5/420 |
| 5,791,114 | A * | 8/1998 | Mandel | 52/591.3 |
| 6,526,705 | B1 * | 3/2003 | MacDonald | 52/177 |
| 2002/0007896 | A1 * | 1/2002 | Huber | 156/159 |
| 2003/0131549 | A1 * | 7/2003 | Kappeli et al. | 52/390 |

* cited by examiner

*Primary Examiner* — William Gilbert

(57) ABSTRACT

A disk shaped modular floor tile includes three sets of a first projection, a second projection, and a third projection wherein the second and third projections of the same set are arranged oppositely to each other; and notches each formed between any adjacent first projection and second projection, any adjacent second projection and third projection, or any adjacent third projection and first projection. The first projection has a convex edge between two adjacent notches. The notch has a concave edge formed continuously with the convex edge. Each of the second projection and the third projection comprises a convex edge formed continuously with the concave edge, a first straight edge formed continuously with the convex edge, and a second straight edge formed continuously between the first straight edge and the concave edge. The second straight edge is at an obtuse angle with respect to the first straight edge.

1 Claim, 6 Drawing Sheets

MODULAR FLOOR TILE

BACKGROUND OF THE INVENTION

1. Field of the Invention

The invention relates to floor tiles and more particularly to a modular floor tile.

2. Description of Related Art

A conventional modular floor tile A shaped as a square is shown in FIG. 1 and comprises a plurality of notches A1 along four edges, and a plurality of projections A2 each defined between two adjacent notches A1. Both the notch A1 and the projection A2 are shaped as a "T".

Notwithstanding the prior art, the invention is neither taught nor rendered obvious thereby.

SUMMARY OF THE INVENTION

It is therefore one object of the invention to provide a disk shaped modular plastic floor tile comprising three sets of a first projection, a second projection, and a third projection arranged clockwise on an edge wherein the second projection and the third projection of the same set are arranged oppositely to each other; and a plurality of notches each formed between any adjacent first projection and second projection, any adjacent second projection and third projection, or any adjacent third projection and first projection; wherein the first projection has a convex edge formed between two adjacent notches; wherein the notch has a concave edge formed continuously with the convex edge; wherein each of the second projection and the third projection comprises a convex edge formed continuously with the concave edge, a first straight edge formed continuously with the convex edge, and a second straight edge formed continuously between the first straight edge and the concave edge; wherein the second straight edge is at an obtuse angle with respect to the first straight edge; and wherein the obtuse angle between the first straight edge and the second straight edge of the second projection is distal that of the third projection rather than facing each other.

The above and other objects, features and advantages of the invention will become apparent from the following detailed description taken with the accompanying drawings.

DETAILED DESCRIPTION OF THE INVENTION

Figure 1:
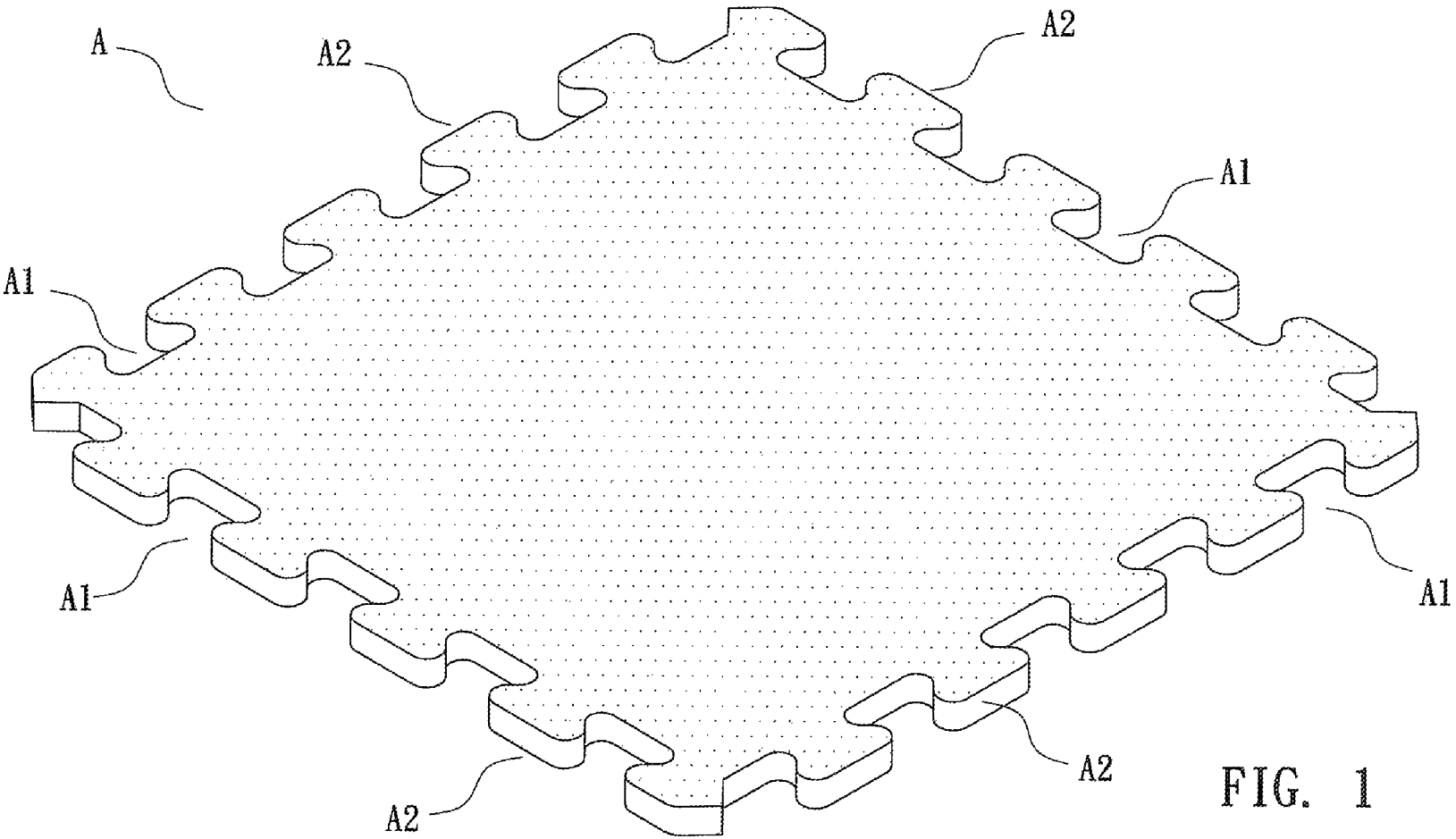
FIG. 1 PRIOR ART
FIG. 1 is a perspective view of a typical modular floor tile.
Figure 2:
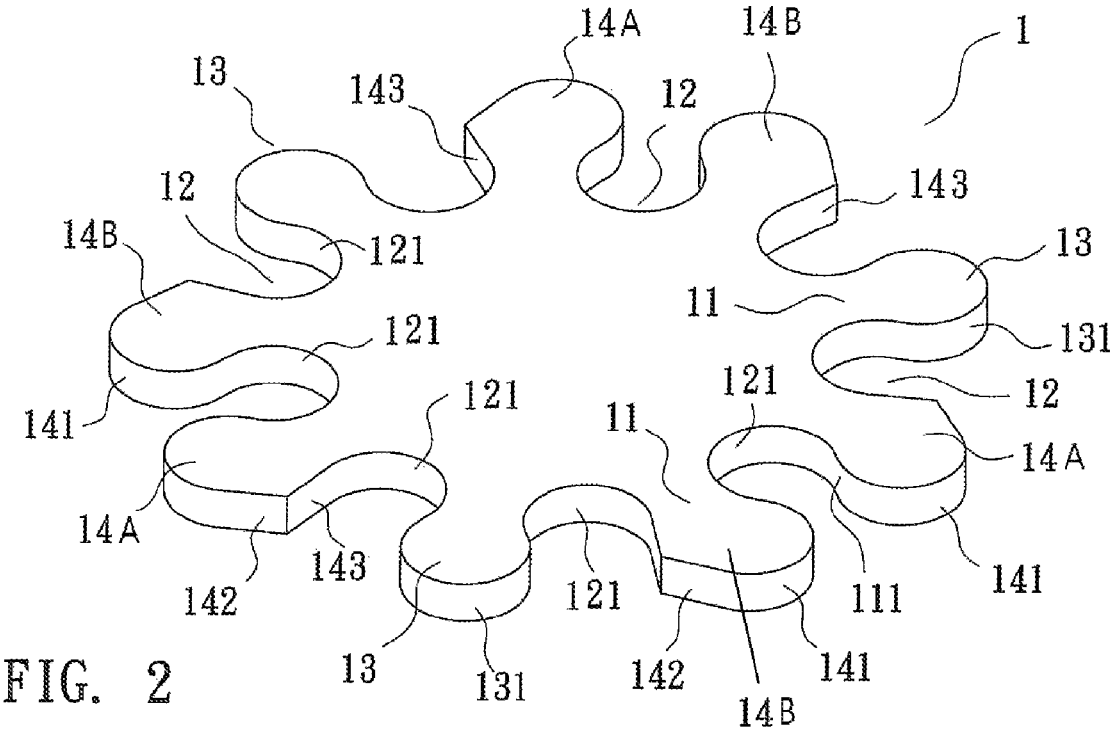
FIG. 2 is a perspective view of a modular floor tile according to a first preferred embodiment of the invention.
Figure 3:
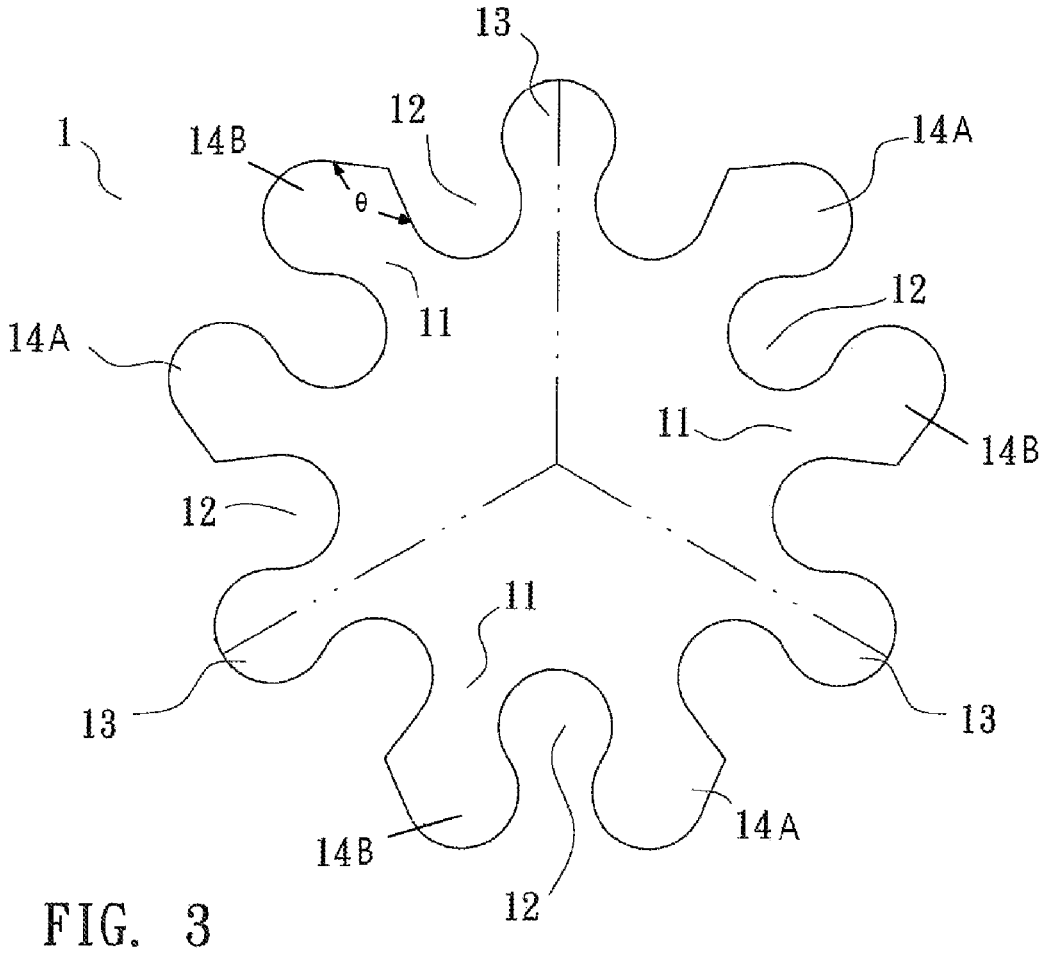
FIG. 3 is a top view of the floor tile of FIG. 2.

Referring to FIGS. 2 to 5, a modular floor tile 1 in accordance with a first preferred embodiment of the invention comprises the following components as discussed in detail below. The floor tile 1 is made of plastic and substantially shaped as a disk.

The floor tile 1 comprises three sets of a first projection 13, a second projection 14A, and a third projection 14B arranged clockwise on an edge in which the second projection 14A and the third projection 14B of the same set are opposite. Root of each of the first projection 13, the second projection 14A, and the third projection 14B is formed as a neck 11. A notch 12 is formed between any two adjacent first projection 13 and second projection 14A, any two adjacent second projection 14A and third projection 14B, or any two adjacent the third projection 14B and first projection 13.

The first projection 13 has a convex edge 131 formed between two adjacent notches 12. The notch 12 has a concave edge 121 formed continuously with the convex edge 131. Each of the second projection 14A and the third projection 14B comprises a convex edge 141 formed continuously with the concave edge 121, a first straight edge 142 formed continuously with the convex edge 141, and a second straight edge 143 formed continuously between the first straight edge 142 and the concave edge 121, the second straight edge 143 being at an obtuse angle θ with respect to the first straight edge 142. The obtuse angle θ between the first straight edge 142 and the second straight edge 143 of the second projection 14A is distal that of the third projection 14B rather than facing each other.

Figure 4:
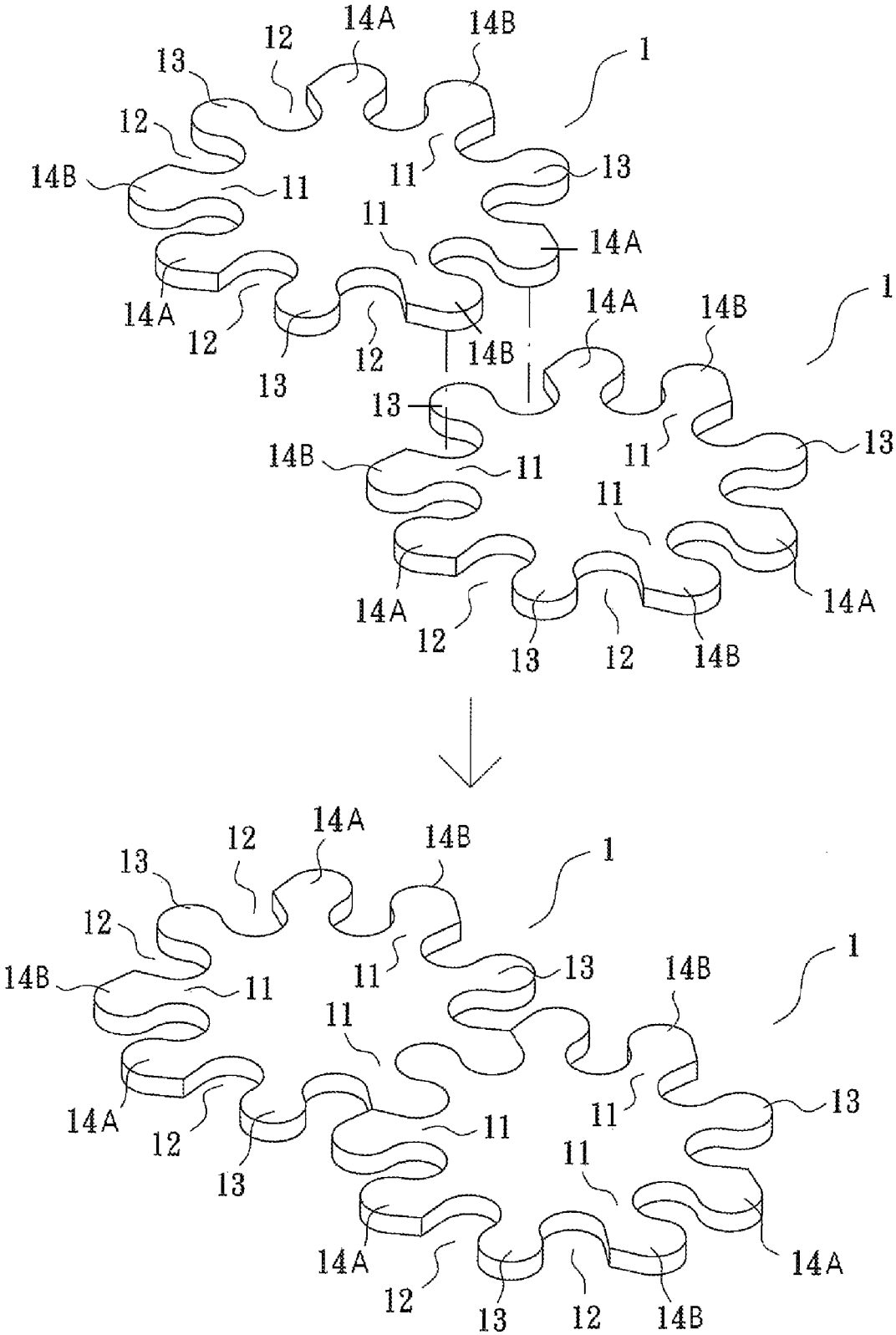
FIG. 4 is a perspective view showing an assembly of two floor tiles of FIG. 2.

As shown in FIG. 4 specifically, two floor tiles 1 can be assembled together by fitting the second projection 14A and the third projection 14B of one floor tile 1 into the notches 12 of the other floor tile 1.

Figure 5:
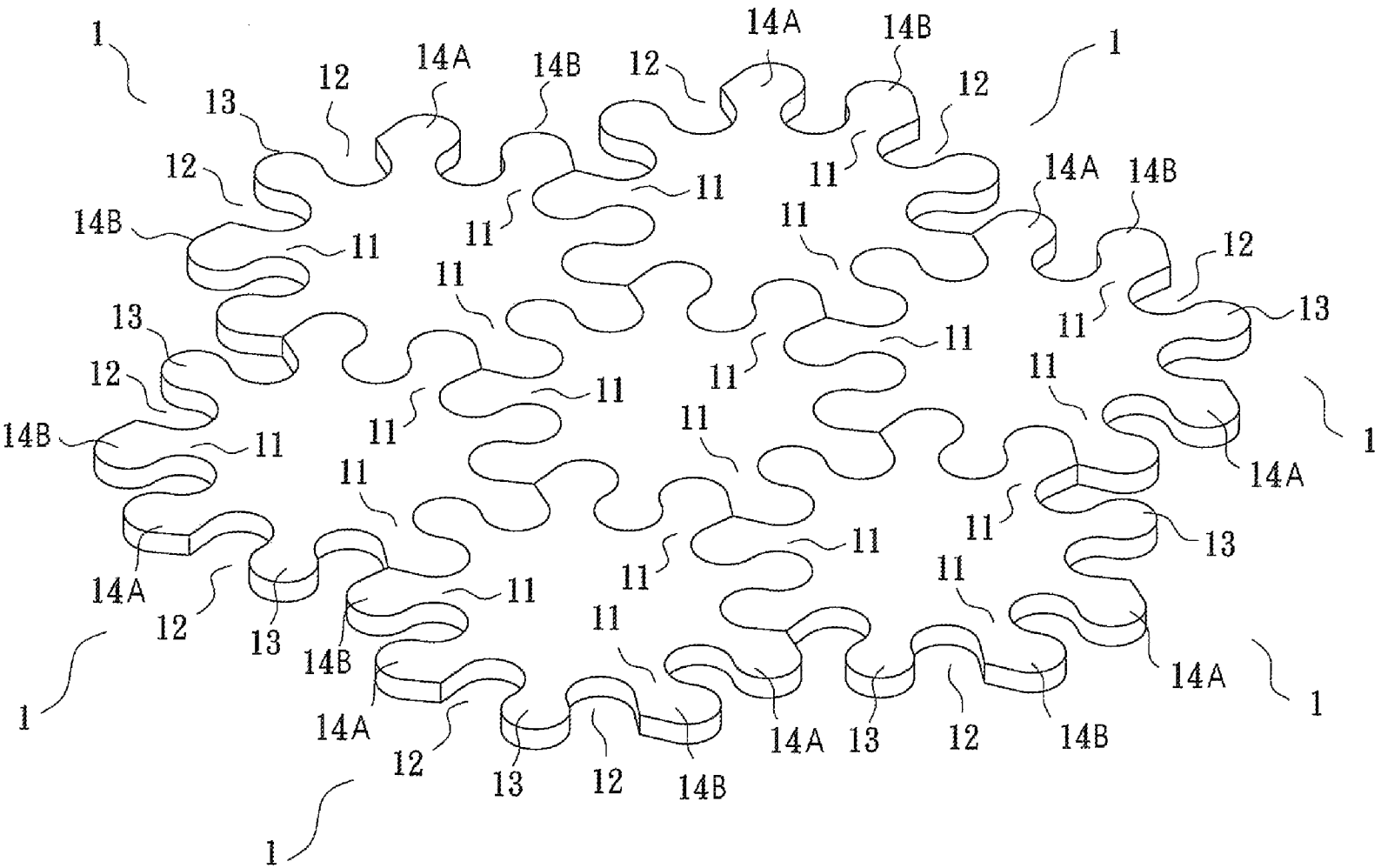
FIG. 5 is a perspective view of an assembly of seven floor tiles of FIG. 2.

As shown in FIG. 5 specifically, two floor tiles 1 can be assembled together by fitting the second projection 14A and the third projection 14B of one floor tile 1 into the notches 12 of the other floor tile 1. Another floor tile 1 then can be assembled with the above two assembled floor tiles 1 by fitting the second projection 14A and the third projection 14B thereof into the notches 12 of one of the above two assembled floor tiles 1, and the first projection 13 into the notch 12 of the other of the above two assembled floor tiles 1. Likewise, seven floor tiles 1 can be assembled as a pattern similar to a disk.

Figure 6:
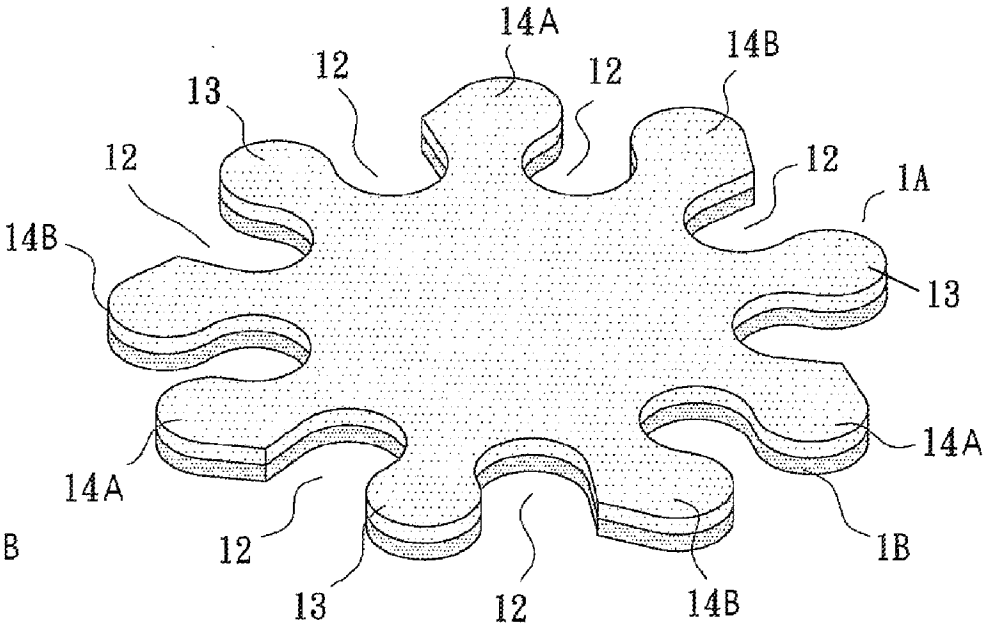
FIG. 6 is a perspective view of a modular floor tile according to a second preferred embodiment of the invention, viewed from top.
Figure 7:
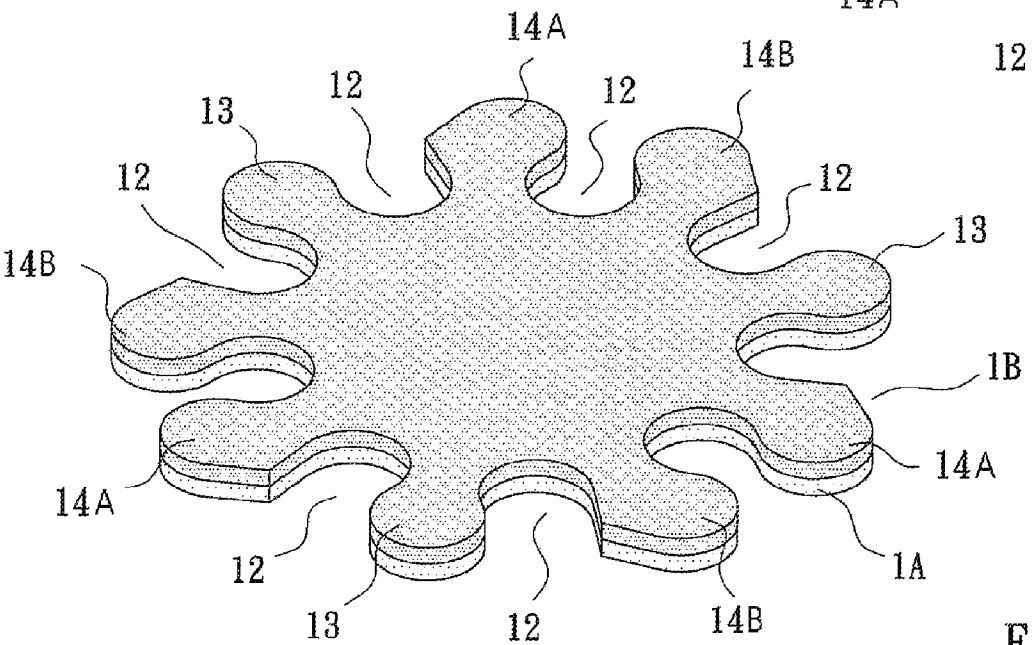
FIG. 7 is a perspective view of the modular floor tile of FIG. 6 but viewed from bottom.
Figure 8:
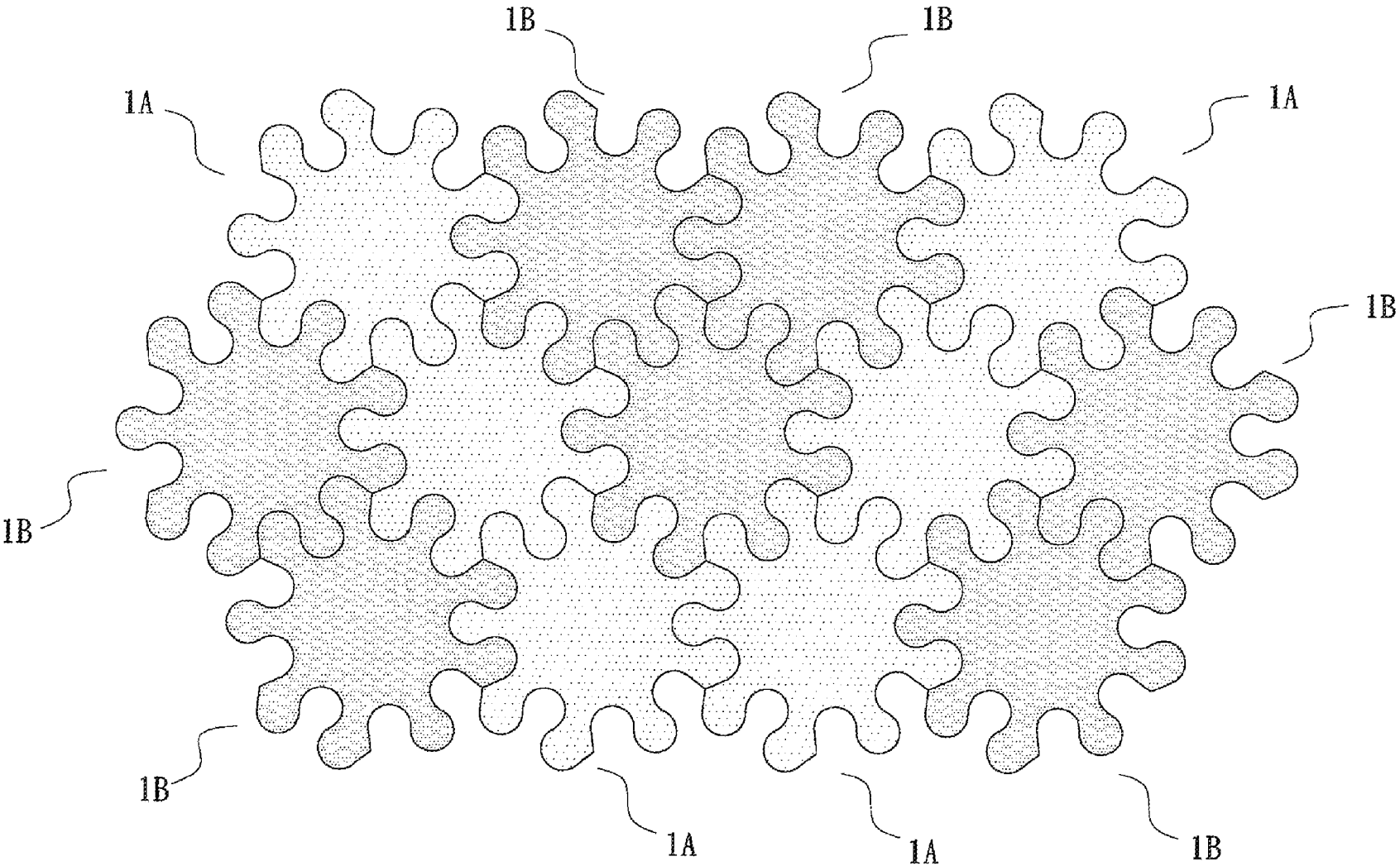
FIG. 8 is a perspective view showing an assembly of 13 floor tiles of FIG. 6.

Referring to FIGS. 6 to 8, a modular floor tile in accordance with a second preferred embodiment of the invention is shown. The characteristics of the second preferred embodiment are substantially the same as that of the first preferred embodiment except the following:

A modular floor tile 1A having a first color and a modular floor tile 1B of the same shape but having a second color different from the first color are formed together as a unit. Each unit can be assembled with at least one unit to form a desired pattern.

While the invention has been described in terms of preferred embodiments, those skilled in the art will recognize that the invention can be practiced with modifications within the spirit and scope of the appended claims.

What is claimed is:

1. A disk shaped modular plastic floor tile comprising:

three sets of a first projection (13), a second projection (14A), and a third projection (14B) arranged clockwise on an edge wherein the second projection (14A) and the third projection (14B) of the same set are spaced apart; and a plurality of notches (12) each formed between any adjacent first projection (13) and second projection (14A), any adjacent second projection (14A) and third projection (14B), or any adjacent third projection (14B) and first projection (13);

wherein the first projection (13) has a convex edge (131) formed continuously between two adjacent notches (12);

wherein each respective notch (12) of the plurality of notches (12) has a concave edge (121) formed continuously with the convex edge (131);

wherein each of the second projection (14A) and the third projection (14B) comprises a convex edge (141) formed continuously with a first of the respective concave edges (121), a first straight edge (142) formed continuously with the convex edge (141), and a second straight edge (143) formed continuously between the first straight edge (142) and a second of the respective concave edges (121);

wherein the second straight edge (143) is at an obtuse angle ($\theta$) with respect to the first straight edge (142); and wherein the convex edge (141) of the second projection (14A) and the convex edge (141) of the third projection (14B) face each other.

* * * * *